US005372307A

United States Patent [19]

Sesser

[11] Patent Number: 5,372,307

[45] Date of Patent: Dec. 13, 1994

[54] ROTARY SPRINKLER STREAM INTERRUPTER

[75] Inventor: George Sesser, Walla Walla, Wash.

[73] Assignee: Nelson Irrigation Corporation, Walla Walla, Wash.

[21] Appl. No.: 103,804

[22] Filed: Aug. 10, 1993

[51] Int. Cl.[5] ..... B05B 3/04; B05B 3/08

[52] U.S. Cl. ..... 239/210; 239/214.13; 239/222.17; 239/222.21; 239/231; 239/382

[58] Field of Search ..... 239/210, 214, 214.13, 239/222.11, 222.17, 222.21, 231, 232, 382

[56] References Cited

U.S. PATENT DOCUMENTS

| | | | |
|---|---|---|---|
| 2,488,234 | 11/1949 | Perry | 239/222.17 |
| 2,592,753 | 4/1952 | Sigmund | 239/231 X |
| 3,727,842 | 4/1973 | Ertsgaard et al. | 239/232 |
| 4,198,000 | 4/1980 | Hunter . | |
| 4,376,513 | 3/1983 | Hagar . | |
| 4,398,666 | 8/1983 | Hunter . | |
| 4,624,412 | 11/1986 | Hunter | 239/232 |
| 4,754,925 | 7/1988 | Rubinstein . | |
| 4,817,869 | 4/1989 | Rubinstein | 239/222.17 |
| 4,836,449 | 6/1989 | Hunter . | |
| 4,836,450 | 6/1989 | Hunter . | |
| 4,984,740 | 1/1991 | Hodge | 239/232 |
| 5,192,024 | 3/1993 | Blee . | |

*Primary Examiner*—William Grant
*Attorney, Agent, or Firm*—Nixon & Vanderhye

[57] ABSTRACT

A sprinkler includes a stationary body portion including a fixed nozzle, and a rotatable rotor plate mounted in a hub in vertically spaced relationship to the nozzle. The rotor plate is adapted to receive and redirect a stream emitted from the nozzle. The hub which mounts the rotor plate has a first plurality of teeth formed on an external, annular surface thereof. An annular stream interrupter is loosely held on the hub and in surrounding relationship to the first plurality of teeth. The interrupter also has a plurality of stream interrupting fingers depending from a radially outermost peripheral surface thereof, arranged to be struck by the stream redirected by the rotor plate. The interrupter includes a ring having a second plurality of teeth formed on an interior annular surface thereof adapted for partial and progressive meshing engagement with the first plurality of teeth to thereby cause the interrupter to orbit the hub in a step-by-step, eccentric motion by the action of the stream on the interrupter fingers.

26 Claims, 3 Drawing Sheets

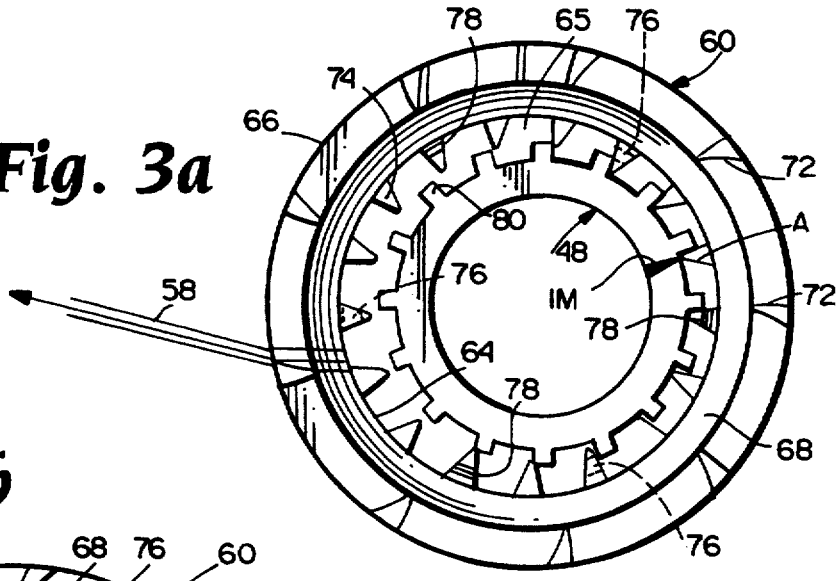
Fig. 3a
Fig. 3b
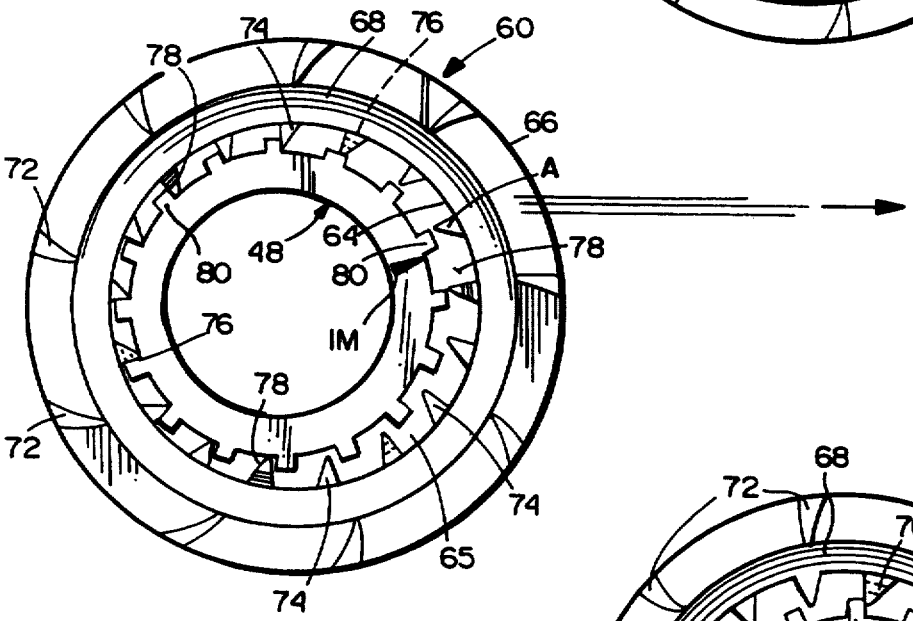
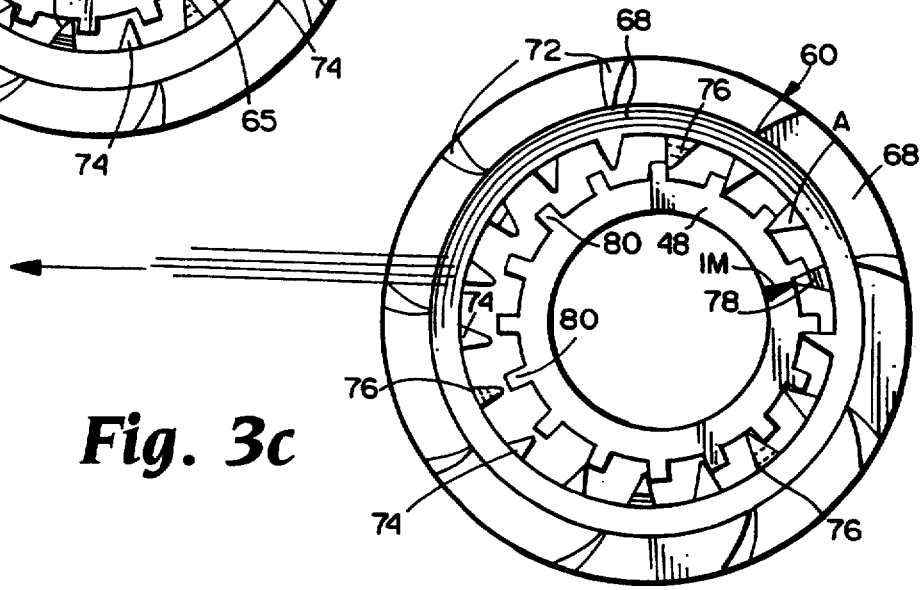
Fig. 3c

ROTARY SPRINKLER STREAM INTERRUPTER

BACKGROUND AND SUMMARY OF THE INVENTION

This invention relates to a rotary sprinkler and, more specifically, to a rotary sprinkler having a stream interrupter driven in a step-wise, eccentric rotational manner by a rotating solid stream emitted from a fixed nozzle.

Stream interrupters per se are utilized in the sprinkling art for a variety of reasons. Representative examples as described in the patent literature are found in U.S. Pat. Nos. 5,192,024; 4,836,450; 4,836,449; 4,376,513; and 3,727,842.

One reason for providing stream interrupters is to insure uniformity of the sprinkling pattern. When irrigating large areas with sprinklers, the sprinklers need to be spaced as far apart as possible in order to minimize system costs. To achieve an even distribution of water at wide sprinkler spacings requires sprinklers that simultaneously throw the water a long distance and produce a pattern that "stacks up" evenly when overlapped with adjacent sprinklers. These two requirements are somewhat mutually exclusive in that maximum radius of throw is achieved with a single concentrated stream of water shooting at a relatively high trajectory angle (approximately 24° from horizontal), but this stream by itself produces a "donut" pattern that doesn't stack evenly. Interrupting this concentrated stream, by fanning some of it vertically downwardly produces a more even pattern, but reduces the radius of throw.

The solution in accordance with this invention is to intermittently interrupt the stream so that at times, it is undisturbed for maximum radius of throw, and at other times it is fanned out to even out the pattern. To this end, the interrupter itself is moved in small rotational increments, so that the interruption points constantly move, thereby resulting in an even distribution of water around the sprinkler, and thereby precluding widely spaced dry "spoke" areas as would be left with a fixed interrupter.

Thus, in an exemplary embodiment of the invention, a self-stepping stream interrupter is provided which is designed for use in a sprinkler of the type where a stream is emitted in a substantially vertical direction from a nozzle fixed in the sprinkler body, which stream thereafter impinges on a groove formed in a rotor plate which redirects the stream radially outwardly. The groove in the rotor plate also has a circumferential component which causes the rotor plate to rotate about its center axis, which also passes through the nozzle. In the exemplary embodiment, the rotational speed of the rotor plate is slowed by a viscous fluid brake or dampener, so that the stream rotates at a speed of less than 20 rpm. In this way, both maximum throw and maximum stream integrity are achieved. Absent an interrupter, this arrangement would produce the so-called "donut" pattern described above.

In the exemplary embodiment, the rotor plate is supported on the viscous brake shaft which extends out of a brake housing supported within a sleeve or hub of the sprinkler cap assembly. The cap assembly is (removably) secured to the body of the sprinkler such that the rotor plate groove is located in vertically spaced relationship, and centered on the axis of the fixed nozzle.

The present invention seeks to take advantage of the maximum throw characteristics achieved by the relatively slow rotation of the rotor plate, and at the same time, to insure a uniform sprinkling pattern extending through a full 360° radially between the sprinkler and the outermost portion of the sprinkling pattern.

In the exemplary embodiment described herein, a stream interrupter is provided which comprises an annular ring having a plurality of teeth extending radially inwardly from the inner surface of the ring. These interrupter teeth are adapted to partially engage a plurality of teeth formed on an exterior annular surface of the cap assembly hub which supports the rotor plate and associated viscous brake housing.

The interrupter in this exemplary embodiment is held loosely supported on a washer so that the interrupter can move axially in opposite directions, but not beyond the teeth on the cap assembly hub. At the same time, the minor diameter of the interrupter teeth is significantly larger than the minor diameter of the hub teeth, so that the interrupter is free to move in several directions, as well as rotationally, when struck by the stream coming off the rotor plate.

The interrupter is also provided with a plurality of depending stream interrupter fingers extending downwardly from the ring. These fingers are shaped as vanes, so that when a finger is struck by the stream, radial, circular, and tilting motions are imparted to the interrupter, as described in greater detail below.

The primary result of the oversized relationship of the interrupter vis-a-vis the hub, is that the interrupter is caused to "walk" around the hub in a step-by-step eccentric manner as the deflector fingers are struck, one at a time, by the stream emitted from the rotor plate. The vane configuration also deflects the stream sideways so that, as the stream rotates with the rotor plate, more and more of the pattern area is wetted so that, ultimately, a uniform sprinkling pattern is achieved throughout the full radial extent of the pattern.

Thus, in its broader aspects, the present invention relates to a sprinkler having a body portion including a nozzle, the nozzle adapted to emit a stream of liquid to atmosphere; first means for rotating the stream; a rotatable stream interrupter driven directly by the stream; and second means for causing intermittent rotation of the stream interrupter.

In another aspect, the invention relates to a sprinkler comprising a sprinkler body having a substantially vertical axis and means for throwing a liquid stream substantially radially relative to the vertical axis and rotating the liquid stream about the vertical axis, the improvement comprising a stream interrupter including an annular ring loosely mounted for eccentric rotation about the vertical axis, and wherein the stream drives the interrupter directly.

In another aspect, the invention relates to a sprinkler comprising a sprinkler body having a center axis and including a nozzle and associated first means for issuing a stream in a substantially radial direction, substantially perpendicular to the axis, and rotating the stream about the center axis; a stream interrupter mounted loosely for eccentric rotation about the center axis, the stream interrupter including an annular ring provided with a plurality of stream deflector fingers, the stream interrupter being driven directly by the stream impinging on the plurality of stream deflector fingers.

In still another aspect, the invention relates to a sprinkler having a fixed nozzle for emitting a stream to atmosphere; a rotor plate adapted to redirect the stream radially outwardly, the rotor plate caused to rotate about its own axis by the stream; and a stream interrupter having a plurality of stream interrupter vanes arranged to be struck by the stream as redirected by the rotor plate.

The invention also relates to a sprinkler having a fixed nozzle for emitting a stream to atmosphere; a rotor plate adapted to redirect the stream radially outwardly, the rotor plate caused to rotate about its own axis by the stream; and a stream interrupter loosely rotatably mounted on a hub, the interrupter having a plurality of stream interrupter vanes arranged to be struck by the stream as redirected by the rotor plate and rotated by the stream about the hub; and wherein the stream interrupter and the hub are provided with cooperating means for causing the interrupter to rotate in an eccentric step-wise manner about the hub.

The invention also relates to a sprinkler having a stationary body portion including a fixed nozzle, a rotatable rotor plate mounted in vertically spaced relationship to the nozzle, the rotor plate adapted to receive and redirect a stream emitted from the nozzle, the improvement comprising a hub having a first plurality of teeth formed on an external, annular surface thereof, and an annular stream interrupter loosely held on the hub and in surrounding relationship to the first plurality of teeth, the interrupter including a ring having a plurality of stream interrupting fingers arranged to be struck by the stream redirected by the rotor plate, the ring also having a second plurality of teeth formed on an interior annular surface thereof adapted for partial and progressive meshing with the first plurality of teeth to thereby cause the interrupter to orbit about the hub in a step-by-step, eccentric motion, as the fingers are successively struck by the stream.

While the stream interrupter of this invention is designed for use with a rotary sprinkler construction as described above, it will be appreciated that the stream interrupter may be applied to any rotary sprinkler that has a single concentrated emitting stream that rotates at a relatively slow speed.

Other objects and advantages of the invention will become apparent from the detailed description which follows.

FIGS. *3a–3c* are bottom elevations (with parts omitted for clarity) illustrating different positions of the stream interrupter as a function of the rotating stream issuing from the rotor plate in accordance with the exemplary embodiment of the invention.

DETAILED DESCRIPTION OF THE DRAWINGS

Figure 1:
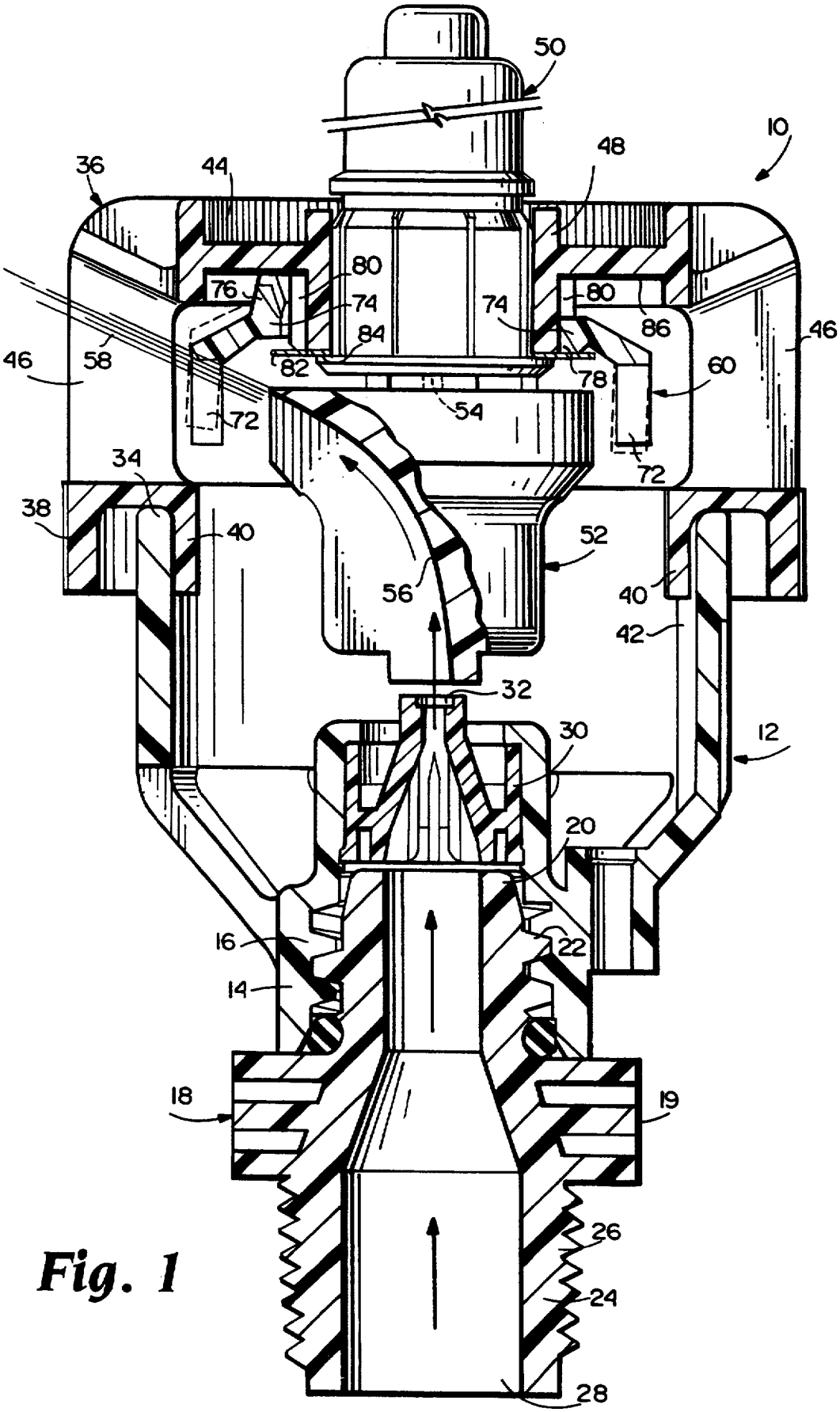
FIG. 1 is a side elevation, partially in section, of a rotary sprinkler incorporating a self-stepping stream interrupter in accordance with an exemplary embodiment of the invention.
Figure 2:
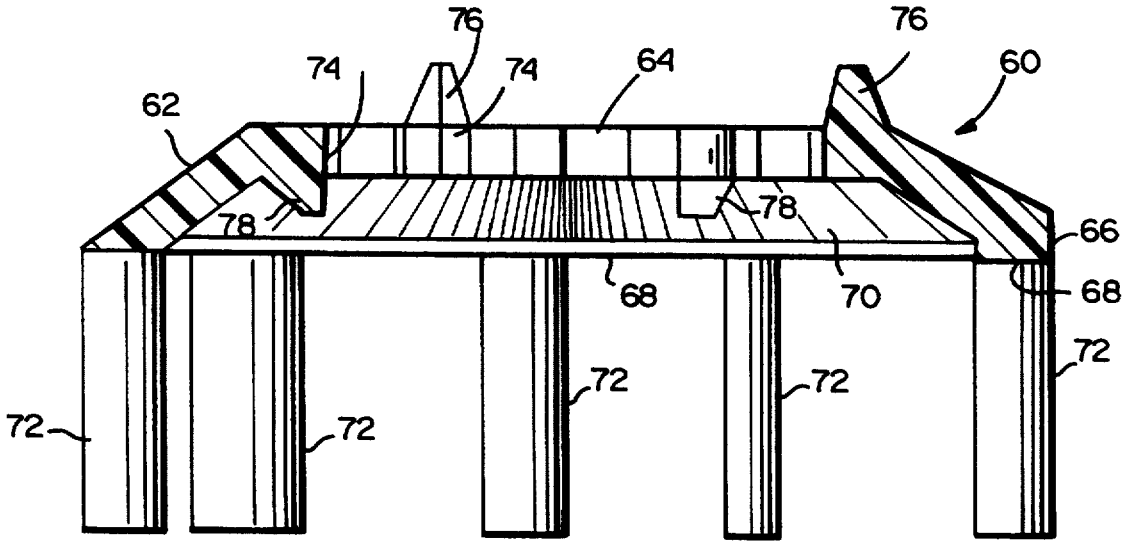
FIG. 2 is a side elevation of a stream interrupter of the type incorporated into the sprinkler construction of FIG. 1.

Referring to FIG. 1, a rotator sprinkler 10 includes a sprinkler body 12 having an inlet end 14 provided with an interior screw thread 16 which receives an adaptor 18. The adaptor 18 has a forward end 20 formed with an exterior screw thread 22 adapted to engage the thread 16, and a rearward end 24 which is formed with another exterior screw thread 26 which is adapted to receive a hose or other coupling. An intermediate portion of the adapter is provided with flat surfaces 19 which enable rotation of the adapter by a wrench or similar tool. The adaptor 18 is also formed with an interior through-bore 28 which directs the water supply stream to an axially aligned nozzle 30 secured within the body 12, for discharge (generally vertically upwardly or downwardly along a center axis of the sprinkler) to atmosphere through a nozzle orifice 32.

The sprinkler body 12 is formed with an upper, open end as defined by an annular rim 34 which is adapted to receive a cap assembly 36 in a releasably locked orientation. The cap assembly 36 includes a locking skirt 38, including suitable locking tabs 40 which are designed to resiliently engage lugs (one shown at 42) on the body adjacent the rim 34 so as to releasably hold the cap assembly in place on the sprinkler body. To remove the cap assembly, it is only necessary to squeeze the cap and rotate it to a release position. The manner in which the cap is secured to and released from the sprinkler body, however, forms no part of this invention.

The cap assembly 36 also includes an upper disc 44 supported above the locking skirt 38 by four struts or vanes 46 (two shown), equally spaced about the circumference of the disc 44. The disc 44 includes a centrally oriented hub 48 which frictionally receives a viscous brake or rotor motor 50 in axial alignment with the nozzle 30. The motor 50 mounts a rotor plate 52 via an output shaft 54 (shown in phantom). The rotor plate 52 is formed with a stream emitting groove 56 which is formed with circumferential component so that when the stream emitted from the nozzle orifice 32 impinges on the groove 56, the rotor plate 52 is caused to rotate, along with shaft 54 and a rotor (not shown) located within the rotor motor 50. The rotor motor 50 is a viscous fluid brake or dampener of the type disclosed in commonly owned U.S. Pat. Nos. Re. 33,823, and 4,796,811. Thus, the rotor motor or brake is effective to slow the rotation of the rotor plate 52 to a speed of from about $\frac{1}{4}$ to less than about 20 rpm. In this way, the stream 58 emitted from the sprinkler is not broken up by the speed of the rotor plate, and thus achieves maximum radial throw.

The solid stream does rotate past the upstanding vanes 46, but any dry "spoke" area which might otherwise result from the vanes 46 is substantially negated by the shape of the vanes which causes the stream to deflect slightly in a circumferential direction as it passes over the vanes.

The above described sprinkler construction is a commercially available sprinkler, sold under the name BR 200 SERIES ROTATOR, manufactured by the assignee, Nelson Irrigation Corp.

This invention relates to the utilization of a stream interruptor shown at 60 which serves to intermittently break up the stream 58 to the extent of establishing a substantially uniform sprinkling pattern in the radial direction, but without significantly affecting radial throw. In other words, absent the interruptor, the essentially solid, unbroken and slowly rotating stream 58 would soak an annular area remote from the sprinkler but would leave a substantially dry annular area radially between the sprinkler and the area where the stream strikes the ground. A fixed stream interruptor solves the problem to some extent, but often leaves dry "spokes" extending radially outwardly from the sprinkler. The intermittent rotation of the stream interrupter 60 in this invention insures uniformity of sprinkling throughout the pattern area.

The interrupter 60 in accordance with the preferred embodiment of this invention, is best seen in FIGS. 2 and 3a–3c. The interrupter 60 comprises an annular tapered ring 62 having an inner annular edge 64 defining a center opening 65, and an outer annular edge 66. The upper surface of the ring 62 tapers downwardly and outwardly between the inner annular edge 64 and the outer annular edge 66. The outer annular edge 66 intersects a lower horizontal edge 68 which, in turn, merges with a lower tapered surface 70 which terminates at the inner annular edge 64. Depending from the lower horizontal edge 68 are a series of axially downwardly extending, vane-shaped interruptor fingers 72. As best seen in FIGS. 3a–3c, these interrupter fingers are shaped to cause intermittent rotation of the interrupter 60 as the fingers are struck, successively, by the stream 58 as it leaves the rotor plate groove 56, as described further herein.

A plurality of annularly spaced and relatively sharply pointed teeth 74 are formed about the inner annular edge 64 and extend radially inwardly as also best seen in FIGS. 3a–3c. Three of the teeth 74 are formed with upwardly extending spacers or lugs 76, while three other of the teeth 74 are formed with downwardly extending spacers or lugs 78, the purpose for which will be explained below.

With reference again to FIG. 1, the hub 48 of the cap assembly 36 has an annular exterior surface formed with a plurality of relatively stubby teeth 80, each of which has a substantially rectangular (or square) profile (see FIGS. 3a–3c).

In the exemplary embodiment, the number of teeth 80 on the hub 48 is one fewer than the number of teeth 74 on the interrupter 60, and the teeth 80 are designed to partially mesh with the teeth 74 during intermittent rotation of the interrupter, as also described below.

A thin washer 82 is supported on a lower flange 84 of the brake housing 50 and this washer, in turn, supports the interrupter 60, as best seen in FIG. 1. Thus, the interrupter 60 is generally confined between the underside 86 of the disc 44 and the washer 82.

Returning to FIGS. 3a–3c, it will be seen that the minor or inner diameter of the interruptor 60 as defined by the radially innermost projections of teeth 74 is considerably larger than the minor or inner diameter of the hub 48 as defined by the radially innermost portions of teeth 80. It will thus be appreciated that the interrupter is capable of significant (albeit limited) axial, radial (i.e., sideways, relative to the center axis of the sprinkler) and tilting movement relative to the cap assembly 36. At the same time, the interrupter is able to "walk" around the hub, eccentrically relative to the axis passing through the nozzle orifice 32 and the rotor plate shaft 54.

The operation of the interruptor 60 will now be described with particular reference to FIGS. 3a–3c.

Generally, as the emitting stream 58 rotates with the rotor plate 52 at a relatively low speed, i.e., less than 20 rpm, the stream 58 strikes one finger 72 after the other, causing the interruptor 48 to intermittently "walk" slowly around the cap hub 48 in a step-by-step, eccentric fashion. In the illustrated, exemplary design, the cap hub 48 has sixteen teeth, and the interruptor 60 has seventeen teeth. Therefore, the interruptor 60 will advance one tooth per revolution of the rotor plate 52 which in this case is equal to 22.5° per revolution. Since there are nine fingers 60 on the interruptor, each time the stream 58 strikes a finger, the interruptor 60 will advance 22.5/9° or 2.5°. Since the fingers 72 are equally spaced at 40° intervals, and since the interruptor 60 moves 2.5°/per strike, interruption occurs at every 42.5° of rotor plate revolution. Thus, after seventeen revolutions of the rotor plate 52, interruption will have occurred at every 2.5° of rotor plate revolution. These are sufficiently small enough increments to substantially uniformly fill in the pattern in the intermediate radial area between the sprinkler and the stream maximum throw distance. At the same time, because the interrupter fingers 72 are only intermittently struck, the maximum radial throw is maintained between strikes.

It will be appreciated that the 2.5° increments can be altered simple by changing the number of stream interrupter fingers.

Referring now specifically to FIGS. 3a, as the emitting stream 58 rotates via the rotor plate 52. In a counterclockwise direction, the stream 58 will strike an interrupter finger 72 causing the stream 58 to deflect laterally (in a circumferential direction) which creates reactionary forces that: a) push the interruptor 60 radially in the direction of the emitted stream, and b) rotate the interruptor 60 as far as the clearance between engaging teeth 74, 80 will allow. As shown in FIG. 3a, the interrupter has moved radially to the left and has rotated by an amount effectively equal to about the width of the struck tooth 74. On the side opposite the emitting stream 58, the teeth 74 and 80 on the interrupter 60 and hub 48, respectively, are engaged, and thus prevent the interrupter from spinning freely around the cap hub 48. For purposes of comparison with FIGS. 3b and 3c, note the position of the index mark IM on the hub 48, and the interrupter tooth A.

FIG. 3b illustrates the position of the interrupter 60 in a position ½ revolution later than the position illustrated in FIG. 3a. In other words, in FIG. 3b, the stream 58 has rotated approximately 180° from the position illustrated in FIG. 3a. Note that in this position, the interrupter has moved radially to the right, in the direction of the emitted stream 58 while the teeth on the interrupter and hub on the side opposite the stream 58 are now engaged. In addition, the tooth A has rotated relative to the index mark IM approximately as shown.

FIG. 3c illustrates the position of the interrupter 60 vis-a-vis the hub 48 as the stream approaches the end of a full 360° rotation, and returns substantially to the position illustrated in FIG. 3a. Note that the tooth A has advanced 1 full hub tooth beyond the index mark IM.

It will be appreciated that as already noted the number of fingers 72 may be varied, and the shape and spacing of the fingers may be varied as well. The number of teeth 74 on the interruptor and the number of teeth 80 on the cap hub, respectively, may also be varied.

There are a number of features in the above described preferred arrangement which allow the unit to work reliably in dirty environments, such as blowing sand:

(1) The interruptor teeth 74 are tall radially, and also very narrow and pointed in shape radially, thereby leaving considerable clearance between the teeth 74 and the squared off hub teeth 80;

(2) There is substantial axial clearance between the interruptor 60 and the cap assembly disc 44 by reason of the three upstanding lugs 74 and similar axial clearance between the interrupter 60 and the washer 82 by reason of the three depending lugs 78;

(3) The interruptor 60 is free to move in several directions. In addition to the step-by-step orbital motion described above, the interruptor 60 tilts upwardly each time the emitting stream strikes a finger 72 and then falls back down as the stream 58 clears the finger (as shown in phantom in FIG. 1;

(4) Each time the emitting stream 58 strikes a finger 72, a short burst of water flushes through the hub area of the cap assembly to remove dirt, sand and the like.

The net result of the above features working together, is that sand grains have little opportunity to become tightly jammed between the interruptor 60 and the hub 48, which in turn, allows the interruptor 60 at least some limited movement as the rotor plate 52 turns. As a result, this combination of movement and the flushing of water washes sand and/or other dirt and debris out of the area.

In actual tests, sand has been blown into the hub area until it is packed with sand. When the water is turned on, the rotor plate 52 begins to turn. At first, there is little movement of the interruptor 60 but within a very few revolutions of the rotor plate 52, the interruptor 60 is moving noticeably and within several more revolutions, all of the sand has been washed out.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A sprinkler having a fixed nozzle arranged to emit a solid stream to atmosphere through a nozzle orifice; a rotor plate adapted to redirect the solid stream emitted from the nozzle orifice radially outwardly, said rotor plate caused to rotate about its own axis by said solid stream and wherein said solid stream is emitted to atmosphere from said nozzle orifice along said axis; and a stream interrupter being mounted for eccentric rotation relative to said rotor plate and having a plurality of stream interrupter vanes arranged to be struck by the stream as redirected by said rotor plate, said vanes having profiles causing said stream interrupter to move at least rotationally when struck by said stream.

2. The sprinkler of claim 1 and further including a hub formed with a first plurality of teeth about an exterior annular surface thereof, and wherein said stream interrupter comprises a ring having a second plurality of teeth extending radially inwardly from said ring, only some of said first and second pluralities of teeth being in meshing engagement at any given time, and wherein said second plurality of teeth exceeds said first plurality of teeth by one, so that said interrupter is rotated in a step-wise eccentric manner about said hub.

3. The sprinkler of claim 2 wherein at least one set of said first and second plurality of teeth have a substantially pointed profile.

4. The sprinkler of claim 2 wherein, at any given time, a majority of said second plurality of teeth are not engaged by any of said first plurality of teeth.

5. The sprinkler of claim 2 wherein said first and second plurality of teeth are configured for loosely meshing engagement so as to prevent dirt and debris from jamming said interrupter.

6. The sprinkler of claim 2 wherein said interrupter has a plurality of upstanding lugs on said ring; and further wherein said interrupter has a plurality of depending lugs on said ring.

7. A sprinkler having a fixed nozzle adapted to emit a stream to atmosphere; a rotor plate adapted to redirect the stream emitted from the nozzle radially outwardly, said rotor plate caused to rotate about its own axis by said stream; and a stream interrupter having a plurality of stream interrupter vanes arranged to be struck by the stream as redirected by said rotor plate for rotation of said stream interrupter and further including a hub formed with a first plurality of teeth about an exterior annular surface thereof, and wherein said stream interrupter comprises a ring having a second plurality of teeth extending radially inwardly from said ring, at least some of said first and second pluralities of teeth being in meshing engagement, so that said interrupter is rotated in a step-wise eccentric manner about said hub, wherein said first plurality of teeth have a substantially square or rectangular profile and said second plurality of teeth have a substantially pointed profile.

8. A sprinkler having a fixed nozzle for emitting a stream to atmosphere; a rotor plate adapted to redirect said stream radially outwardly, said rotor plate caused to rotate about its own axis by said stream; and a stream interrupter surrounding said axis having a plurality of stream interrupter vanes arranged to be struck by the stream as redirected by said rotor plate, wherein said interrupter vanes have profiles which cause said interrupter to move radially and rotationally in an eccentric manner when struck by the emitted stream.

9. A sprinkler comprising a body portion including an inlet and an axially aligned, fixed nozzle arranged and configured to emit a solid stream to atmosphere; a rotor plate adapted to redirect the solid stream emitted from said fixed nozzle radially outwardly, said rotor plate caused to rotate about its own axis by said stream; and, a stream interrupter loosely rotatably mounted on a hub, said interrupter having a plurality of stream interrupter vanes arranged to be struck by the stream as redirected by said rotor plate and rotated by said stream about said hub; and wherein said stream interrupter and said hub are provided with cooperating means for causing said interrupter to rotate in an eccentric step-wise manner about said hub.

10. The sprinkler of claim 9 wherein said means further cooperates with said stream interrupter vanes to produce less than or equal to about 2.5° of rotation each time one of said vanes is struck by the stream.

11. The sprinkler of claim 9 wherein said stream interrupter vanes are shaped to cause lateral deflection of the stream.

12. The sprinkler of claim 9 wherein said cooperating means are configured to permit said interrupter to move radially in the direction of the emitted stream each time one of said vanes is struck by said stream.

13. In a sprinkler having a stationary body portion including a fixed nozzle arranged to emit a solid stream to atmosphere along a center axis of said body portion; a rotatable rotor plate mounted in vertically spaced relationship to said fixed nozzle, said rotor plate adapted to receive and redirect said solid stream emitted from the nozzle, the improvement comprising a hub having a first plurality of teeth formed on an external, annular surface thereof, and an annular stream interrupter loosely held on said hub and in surrounding relationship to said first plurality of teeth, said interrupter including a ring having a plurality of stream interrupting fingers arranged to be struck by said stream redirected by said rotor plate, said ring also having a second plurality of teeth formed on an interior annular surface thereof adapted for partial and progressive meshing with said first plurality of teeth to thereby cause said interrupter to orbit about the hub in a step-by-step, eccentric motion, as said fingers are successively struck by said stream.

14. The sprinkler of claim 13 wherein said second plurality of teeth exceeds said first plurality of teeth by one.

15. The sprinkler of claim 13 wherein at least one set of said first and second plurality of teeth have a substantially pointed profile.

16. The sprinkler of claim 13 wherein, at any given time, a majority of said second plurality of teeth are not engaged by any of said first plurality of teeth.

17. The sprinkler of claim 13 wherein said first and second plurality of teeth are configured for loosely meshing engagement so as to prevent dirt and debris from jamming said interrupter.

18. The sprinkler of claim 13 wherein said interrupter has a plurality of upstanding lugs on said ring.

19. The interrupter of claim 18 wherein said interrupter has a plurality of depending lugs on said ring.

20. The interrupter of claim 19 wherein said upstanding and depending lugs, respectively, comprise extensions of respective ones of said second plurality of teeth.

21. The sprinkler of claim 13 wherein said interrupter has a plurality of depending lugs on said ring.

22. In a sprinkler having a stationary body portion including a fixed nozzle, a rotatable rotor plate mounted in vertically spaced relationship to said fixed nozzle, said rotor plate adapted to receive and redirect a stream emitted from the nozzle, the improvement comprising a hub having a first plurality of teeth formed on an external, annular surface thereof, and an annular stream interrupter loosely held on said hub and in surrounding relationship to said first plurality of teeth, said interrupter including a ring having a plurality of stream interrupting fingers arranged to be struck by said stream redirected by said rotor plate, said ring also having a second plurality of teeth formed on an interior annular surface thereof adapted for partial and progressive meshing with said first plurality of teeth to thereby cause said interrupter to orbit about the hub in a step-by-step, eccentric motion, as said fingers are successively struck by said stream, wherein said first plurality of teeth have a substantially square or rectangular profile and said second plurality of teeth have a substantially pointed profile.

23. In a sprinkler having a stationary body portion including a fixed nozzle, a rotatable rotor plate mounted in vertically spaced relationship to said fixed nozzle, said rotor plate adapted to receive and redirect a stream emitted from the nozzle, the improvement comprising a hub having a first plurality of teeth formed on an external, annular surface thereof, and an annular stream interrupter loosely held on said hub and in surrounding relationship to said first plurality of teeth, said interrupter including a ring having a plurality of stream interrupting fingers arranged to be struck by said stream redirected by said rotor plate, said ring also having a second plurality of teeth formed on an interior annular surface thereof adapted for partial and progressive meshing with said first plurality of teeth to thereby cause said interrupter to orbit about the hub in a step-by-step, eccentric motion, as said fingers are successively struck by said stream, wherein said interrupter fingers have profiles which cause said interrupter to move radially and rotationally when struck by the emitted stream.

24. A sprinkler having a body portion including a nozzle, said adapted to emit a stream of liquid along an axis of said nozzle to atmosphere; first means for rotating the stream; a rotatable stream interrupter surrounding said axis and driven directly by said stream; and second means for causing intermittent and eccentric rotation of the stream interrupter about said axis.

25. A sprinkler comprising a sprinkler body having a substantially vertical axis and means for throwing a liquid stream substantially radially relative to said vertical axis and rotating said liquid stream about said vertical axis, the improvement comprising a stream interrupter including an annular ring loosely mounted for eccentric rotation about said vertical axis, and wherein said stream drives said interrupter directly.

26. A sprinkler comprising a sprinkler body having a center axis and including a nozzle and associated first means for issuing a stream in a substantially radial direction, substantially perpendicular to said axis, and rotating said stream about said center axis; a stream interrupter mounted loosely for eccentric rotation about said center axis, said stream interrupter including an annular ring provided with a plurality of stream deflector fingers, said stream interrupter being driven directly by said stream impinging on said plurality of stream deflector fingers.

* * * * *